US008087768B2

(12) United States Patent
Daems et al.

(10) Patent No.: US 8,087,768 B2
(45) **Date of Patent: *Jan. 3, 2012**

(54) INK-JET AUTHENTICATION MARK FOR A PRODUCT OR PRODUCT PACKAGING

(75) Inventors: Eddie Daems, Herentals (BE); Luc Leenders, Herentals (BE); Hans Strijckers, Oudergem (BE)

(73) Assignee: Agfa Graphics NV, Mortsel (BE)

( * ) Notice: Subject to any disclaimer, the term of this patent is extended or adjusted under 35 U.S.C. 154(b) by 719 days.

This patent is subject to a terminal disclaimer.

(21) Appl. No.: 11/916,059

(22) PCT Filed: May 29, 2006

(86) PCT No.: PCT/EP2006/062658

§ 371 (c)(1), (2), (4) Date: Nov. 30, 2007

(87) PCT Pub. No.: WO2006/128840

PCT Pub. Date: Dec. 7, 2006

(65) Prior Publication Data

US 2008/0192103 A1 Aug. 14, 2008

Related U.S. Application Data

(60) Provisional application No. 60/694,229, filed on Jun. 27, 2005.

(30) Foreign Application Priority Data

Jun. 2, 2005 (EP) ..... 05104785

(51) Int. Cl.
*B41J 2/01* (2006.01)

(52) U.S. Cl. ..... 347/100; 347/96; 347/98; 347/102; 347/105

(58) Field of Classification Search ..... 347/100, 347/102; 428/32.1, 32.34, 32.4
See application file for complete search history.

(56) References Cited

U.S. PATENT DOCUMENTS

| | | | | |
|---|---|---|---|---|
| 6,837,959 | B2 | 1/2005 | Daems et al. | |
| 2002/0065335 | A1 * | 5/2002 | Noguchi et al. | 522/84 |
| 2002/0105569 | A1 | 8/2002 | Murcia et al. | |
| 2003/0194532 | A1 | 10/2003 | Schulz et al. | |
| 2003/0213550 | A1 * | 11/2003 | Daems et al. | 156/250 |
| 2004/0053017 | A1 * | 3/2004 | Daems et al. | 428/195.1 |
| 2004/0197682 | A1 * | 10/2004 | Sonehara et al. | 430/7 |
| 2004/0219287 | A1 | 11/2004 | Regan et al. | |
| 2004/0262909 | A1 | 12/2004 | Bauer et al. | |
| 2005/0042396 | A1 | 2/2005 | Jones et al. | |
| 2005/0190248 | A1 * | 9/2005 | Konno et al. | 347/102 |
| 2005/0212852 | A1 * | 9/2005 | Konno | 347/40 |
| 2006/0004116 | A1 * | 1/2006 | Kishi et al. | 522/146 |

FOREIGN PATENT DOCUMENTS

| | | | |
|---|---|---|---|
| EP | 1 362 710 | A1 | 11/2003 |
| EP | 1 398 175 | A2 | 3/2004 |

OTHER PUBLICATIONS

Official communication issued in the International Application No. PCT/EP2006/062658, mailed on Aug. 7, 2006.

Leenders et al.; "Ink-Jet Authentication Mark for a Product or Product Packaging"; U.S. Appl. No. 11/916,053, filed Nov. 30, 2007.

* cited by examiner

*Primary Examiner* — Matthew Luu
*Assistant Examiner* — Rut Patel
(74) *Attorney, Agent, or Firm* — Keating & Bennett, LLP

(57) ABSTRACT

A method of ink-jet printing an authentication mark on an article including, in order, the steps of: a) providing an article including an ink-receiving layer; b) applying a curable fluid on an ink-receiving layer according to a first image; c) at least partially curing the curable fluid; and d) jetting at least one ink-jet ink on the ink-receiving layer according to a second image partially overlapping with the first image. The method can be advantageously used to generate a security document.

9 Claims, No Drawings

INK-JET AUTHENTICATION MARK FOR A PRODUCT OR PRODUCT PACKAGING

CROSS-REFERENCE TO RELATED APPLICATIONS

This application is a 371 of PCT/EP2006/062658, filed May 29, 2006. This application claims the benefit of U.S. Provisional Application No. 60/694,229, filed Jun. 27, 2005, which is incorporated by reference. In addition, this application claims the benefit of European Application No. 05104785.0, filed Jun. 2, 2005, which is also incorporated by reference.

BACKGROUND OF THE INVENTION

1. Field of the Invention

The present invention relates to an authentication mark to be applied via ink-jet printing to a product or product packaging that allows at least partial determination whether the product or product packaging is authentic.

2. Description of the Related Art

Authentication marks are used in product packaging to protect the brand identity. Brand identity plays an important role in the marketplace. It provides a way for consumers to identify and rely on products coming from a particular source. It also provides a way for companies to attract and build goodwill with customers, thereby encouraging repeat business. Companies therefore spend billions of dollars on advertising and product development to establish such brand identity.

Authentication marks are also used in security documents, for example, in identification cards, driver licenses, and bankcards. A security document normally combines a number of security features. Usually the number of security features increases with the risk and the consequences if a fake security document would be used. Additional security features are often applied by introduction of complex processes. In U.S. Patent Publication 2004/0219287 (UCB), particles tagged with a DNA strand are used for labeling an article for security, identification and/or authentication purposes.

Frequently, it is required that the label on a product packaging or the security document contains unique information, e.g., a product serial number and/or personal information such as name, address, and a passport photograph. Ink-jet printing has proven to be a very suitable technique to print variable information and images to a security document or a label of a product packaging.

U.S. Patent Publication 2002/0105569 (HP) discloses an ink-jet printing system to create a security document using different ink types. The security document is based on a pigment type ink printed upon a porous ink receiver to form an opaque layer that can be removed by use of mild abrasion so as to reveal a secure message printed earlier with a dye penetrant ink on the porous ink receiver.

Pigmented inks are also used in U.S. Patent Publication 2005/0042396 (DIGIMARC) to assemble identification cards.

U.S. Patent Publication 2003/0194532 (3M) discloses the manufacture of secure ID badges by using ink-jet printing in an image retaining laminate assembly including a first substrate having a first surface and one or more projections extending beyond the first surface, the projections defining a second surface of the first substrate, and a second substrate overlaying the second surface of the first substrate.

In U.S. Pat. No. 6,837,959 (AGFA), ink-jet printing is used to manufacture identification cards containing a watermark revealed by partial impregnation of a UV-curable lacquer into a porous opaque ink-receiving layer.

U.S. Patent Publication 2004/0262909 (GIESECKE & DEVRIENT) discloses a method for individualizing security documents including the steps of providing a document having a first, high security quality printed image 1 having mutually contrasting light and dark areas 1*a*, 1*b*, and printing at least part of the first printed image 1 with a second printed image 2, wherein the material selected for printing the second printed image 2 is a material that is repelled either by the dark areas 1*b* or by the light areas 1*a* of the first printed image 1 and is deposited accordingly in the other areas 1*a* or 1*b* so that it remains only in the other areas.

There have been many attempts to provide security features that are tamperproof or cannot be falsified. However, it has been the experience that after a certain period of time the counterfeiters catch up with the technology used by the industry. There is therefore a constant need to provide novel security features, which are not easy to duplicate, but still use simple processes for their application to a product or product packaging.

SUMMARY OF THE INVENTION

In order to overcome the problems described above, preferred embodiments of the present invention provide a simple method for applying novel authentication marks to a product or product packaging.

It is a further preferred embodiment of the present invention to provide a product or product packaging having authentication marks which are not easy to duplicate.

Further preferred embodiments of the present invention will become apparent from the description hereinafter.

It has been surprisingly discovered that authentication marks can be obtained by jetting and curing a curable fluid on an ink-receiving layer according to a first image and then printing a second image overlapping partially with the first image.

A further preferred embodiment of the present invention has been achieved with a method of ink-jet printing an authentication mark on an article including, in order, the steps of:

a) providing an article including an ink-receiving layer;

b) applying a curable fluid on an ink-receiving layer according to a first image;

c) at least partially curing the curable fluid; and d) jetting at least one ink-jet ink on the ink-receiving layer according to a second image partially overlapping with the first image.

Other features, elements, processes, steps, characteristics and advantages of the present invention will become more apparent from the following detailed description of preferred embodiments of the present invention.

DETAILED DESCRIPTION OF PREFERRED EMBODIMENTS

Definitions

The term "image" as used in preferred embodiments of the present invention means any form of representing information, such as pictures, logos, photographs, barcodes and text. The image may include some form of a "security pattern", such as small dots, thin lines, or fluorescent lines.

The term "UV" is used in preferred embodiments of the present invention as an abbreviation for ultraviolet radiation.

The term "ultraviolet radiation" as used in preferred embodiments of the present invention means electromagnetic radiation in the wavelength range of 100 nanometers to 400 nanometers.

The term "actinic radiation" as used in preferred embodiments of the present invention means electromagnetic radiation capable of initiating photochemical reactions.

The term "Norrish Type I initiator" as used in preferred embodiments of the present invention means an initiator which cleaves after excitation, yielding the initiating radical immediately.

The term "Norrish Type II initiator" as used in preferred embodiments of the present invention means an initiator which is activated by actinic radiation and forms free radicals by hydrogen abstraction or electron extraction from a second compound that becomes the actual initiating free radical.

The term "photo-acid generator" as used in preferred embodiments of the present invention means an initiator which generates an acid or hemi-acid upon exposure to actinic radiation.

The term "thermal initiator" as used in preferred embodiments of the present invention means an initiator which generates initiating radicals upon exposure to heat.

The term "functional group" as used in preferred embodiments of the present invention means an atom or group of atoms, acting as a unit, that has replaced a hydrogen atom in a hydrocarbon molecule and whose presence imparts characteristic properties to this molecule.

The term "monofunctional" means one functional group.

The term "difunctional" means two functional groups.

The term "polyfunctional" means more than one functional group.

The term "filler" as used in preferred embodiments of the present invention means an inorganic or organic particulate material added to an ink-receiving layer to modify its properties, e.g., porosity of the ink-receiving layer, adhesion to a polyester film, opacity of an ink-receiving layer, and triboelectrical properties.

The term "colorant" as used in preferred embodiments of the present invention means dyes and pigments.

The term "dye" as used in preferred embodiments of the present invention means a colorant having a solubility of 10 mg/L or more in the medium in which it is applied and under the pertaining ambient conditions.

The term "pigment" is defined in DIN 55943, herein incorporated by reference, as an inorganic or organic, chromatic or achromatic coloring agent that is practically insoluble in the dispersion medium under the pertaining ambient conditions, hence having a solubility of less than 10 mg/L therein.

The term "water-soluble" as used in preferred embodiments of the present invention means having a solubility of 10 mg/L or more in water under the pertaining ambient conditions.

The term "dispersion" as used in preferred embodiments of the present invention means an intimate mixture of at least two substances, one of which, called the dispersed solid phase or colloid, is uniformly distributed in a finely divided state through the second substance, called the dispersion medium.

The term "polymeric dispersant" as used in preferred embodiments of the present invention means a substance for promoting the formation and stabilization of a dispersion of one substance in a dispersion medium.

The term "wt %" is used in preferred embodiments of the present invention as an abbreviation for % by weight.

The term "alkyl" means all variants possible for each number of carbon atoms in the alkyl group, i.e., for three carbon atoms: n-propyl and isopropyl; for four carbon atoms: n-butyl, isobutyl, and tertiary-butyl; and for five carbon atoms: n-pentyl, 1,1-dimethyl-propyl, 2,2-dimethylpropyl, and 2-methyl-butyl etc.

The term "acyl group" means —(C═O)-aryl and —(C═O)-alkyl groups.

The term "aliphatic group" means saturated straight chain, branched chain, and alicyclic hydrocarbon groups.

The term "unsaturated aliphatic group" means straight chain, branched chain, and alicyclic hydrocarbon groups which contain at least one double or triple bond.

The term "aromatic group" as used in preferred embodiments of the present invention means an assemblage of cyclic conjugated carbon atoms, which are characterized by large resonance energies, e.g., benzene, naphthalene and anthracene.

The term "alicyclic hydrocarbon group" means an assemblage of cyclic conjugated carbon atoms, which do not form an aromatic group, e.g., cyclohexane.

The term "substituted" as used in preferred embodiments of the present invention means that one or more of the carbon atoms and/or that a hydrogen atom of one or more of carbon atoms in an aliphatic group, an aromatic group, or an alicyclic hydrocarbon group, are replaced by an oxygen atom, a nitrogen atom, a halogen atom, a silicon atom, a sulphur atom, a phosphorous atom, selenium atom, or a tellurium atom. Such substituents include hydroxyl groups, ether groups, carboxylic acid groups, ester groups, amide groups, and amine groups.

The term "heteroaromatic group" means an aromatic group wherein at least one of the cyclic conjugated carbon atoms is replaced a nitrogen atom, a sulphur atom, an oxygen atom, or a phosphorous atom.

The term "heterocyclic group" means an alicyclic hydrocarbon group wherein at least one of the cyclic conjugated carbon atoms is replaced by an oxygen atom, a nitrogen atom, a phosphorous atom, a silicon atom, a sulfur atom, a selenium atom, or a tellurium atom.

Ink Receiver

The ink receiver used in the ink-jet printing method according to a preferred embodiment of the present invention includes a support with at least one ink-receiving layer. The ink-receiving layer may consist of just one single layer, or alternatively it may be composed of two or more layers. The ink-receiving layer or at least one of the ink-receiving layers, in the case of multiple layers, contains at least a polymeric binder and a curable compound.

The ink-receiving layer or at least one of the ink-receiving layers, in the case of multiple layers, preferably further contains also at least one filler. The ink-receiving layer can be transparent but is preferably translucent or opaque.

The ink-receiving layer used in the ink-jet printing method according to a preferred embodiment of the present invention may be a colored layer, for example, to give a specific background color to an identification card.

The ink-receiving layer, and an optional auxiliary layer, such as a backing layer for anti-curl and/or adhesive purposes, may further contain well-known conventional ingredients, such as surfactants serving as coating aids, cross-linking agents, plasticizers, cationic substances acting as mordant, light-stabilizers, pH adjusters, anti-static agents, biocides, lubricants, whitening agents, and matting agents.

In the case of a label, the backside of the support is preferably provided with an adhesive backing layer or the support is chosen in such a way (e.g., a polyethylene support) that the label can be thermally laminated onto a substrate such as paper and cartons.

The ink-receiving layer and the optional auxiliary layer(s) may also be cross-linked to a certain degree to provide such desired features as waterfastness and non-blocking characteristics. The cross-linking is also useful in providing abrasion resistance and resistance to the formation of fingerprints on the element as a result of handling.

The dry thickness of the ink-receiving layer or the ink-receiving layers, in the case of multiple layers, is preferably at least 5 μm, for example, more preferably at least at 10 μm, for example, and most preferably at least 15 μm, for example.

The different layers can be coated onto the support by any conventional coating technique, such as dip coating, knife coating, extrusion coating, spin coating, slide hopper coating, and curtain coating.

Supports

The support of the ink receivers used in the ink-jet printing method according to a preferred embodiment of the present invention can be chosen from paper type and polymeric type supports. Paper types include plain paper, cast coated paper, polyethylene coated paper, and polypropylene coated paper. Polymeric supports include cellulose acetate propionate or cellulose acetate butyrate, polyesters such as polyethylene terephthalate and polyethylene naphthalate, polyvinylchloride, polyamides, polycarbonates, polyimides, polyolefins, poly(vinylacetals), polyethers, and polysulfonamides. Other examples of useful high-quality polymeric supports for a preferred embodiment of the present invention include opaque white polyesters and extrusion blends of polyethylene terephthalate and polypropylene. Polyester film supports and especially poly(ethylene terephthalate) are preferred because of their excellent properties of dimensional stability. When such a polyester is used as the support material, a subbing layer may be used to improve the bonding of the ink-receiving layer to the support. Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

Polyolefins are preferred supports for thermal lamination onto a substrate, which is preferably a polyolefin-coated substrate, such as polyolefin-coated paper or carton.

The support of the ink receivers used in the ink-jet printing method according to a preferred embodiment of the present invention may also be made from an inorganic material, such as a metal oxide or a metal (e.g., aluminum and steel).

The support of the ink receivers used in the ink-jet printing method according to a preferred embodiment of the present invention preferably consists of the product itself or the product packaging to be provided with authentication marks.

In a preferred embodiment the support of the ink receivers used in the ink-jet printing method is a transparent support. It was discovered that authentication marks could be created with dye based ink-jet inks exhibiting a higher optical density of the main image in the uncured areas than in the cured areas, i.e., the security image, when looked at in reflection. But when looking from the backside, i.e., through the transparent support, the main image exhibited a lower optical density than the security image. Such authentication marks can be advantageously used in security badges and identification cards.

Polymeric Binders

The ink-receiving layer used in the ink-jet printing method of a preferred embodiment of the present invention preferably contains as a polymeric binder a polyvinylalcohol (PVA) i.e., polyvinyl alcohol, a vinylalcohol copolymer, or modified polyvinyl alcohol. The polyvinyl alcohol is preferably a cationic type polyvinyl alcohol, such as the cationic polyvinyl alcohol grades from KURARAY, such as POVAL™ CM318, POVAL™ C506, POVAL™ C118, and GOHSEFIMER™ K210 from NIPPON GOHSEI.

Other suitable polymeric binders for the ink-receiving layer used in the ink-jet printing method include hydroxyethyl cellulose, hydroxypropyl cellulose, hydroxyethylmethyl cellulose, hydroxypropyl methyl cellulose, hydroxybutylmethyl cellulose, methyl cellulose, sodium carboxymethyl cellulose, sodium carboxymethylhydroxethyl cellulose, water soluble ethylhydroxyethyl cellulose, cellulose sulfate, polyvinyl acetate, polyvinyl acetal, polyvinyl pyrrolidone, polyacrylamide, acrylamide/acrylic acid copolymer, polystyrene, styrene copolymers, acrylic or methacrylic polymers, styrene/acrylic copolymers, ethylene-vinylacetate copolymer, vinyl-methyl ether/maleic acid copolymer, poly(2-acrylamido-2-methyl propane sulfonic acid), poly(diethylene triamine-co-adipic acid), polyvinyl pyridine, polyvinyl imidazole, polyethylene imine epichlorohydrin modified, polyethylene imine ethoxylated, polyethylene oxide, polyurethane, melamine resins, gelatin, carrageenan, dextran, gum arabic, casein, pectin, albumin, starch, collagen derivatives, collodion and agar-agar.

Fillers

The filler in the ink-receiving layer used in the ink-jet printing method of a preferred embodiment of the present invention can be a polymeric particle, but is preferably an inorganic filler, which can be chosen from neutral, anionic, and cationic filler types. Useful fillers include, e.g., silica, talc, clay, hydrotalcite, kaolin, diatomaceous earth, calcium carbonate, magnesium carbonate, basic magnesium carbonate, aluminosilicate, aluminum trihydroxide, aluminum oxide (alumina), titanium oxide, zinc oxide, barium sulfate, calcium sulfate, zinc sulfide, satin white, alumina hydrate such as boehmite, zirconium oxide or mixed oxides.

Suitable polymeric particles include polystyrene and styrene-acrylic copolymer particles having a 0.5 μm particle diameter, for example, and a 0.1 μm shell, for example.

In a preferred embodiment, the filler acts as an opacifier rendering the ink-receiving layer non-transparent.

In another preferred embodiment, the filler has magnetic properties which can be used to introduce additional security features.

The ratio of filler to polymeric binder is preferably between 20/1 and 3/1, for example, for preparing an ink-receiving layer with a high porosity, that is, a so-called micro-porous or a macro-porous ink-receiving layer.

Curable Fluid

The curable fluid for use in the ink-jet printing method according to a preferred embodiment of the present invention may be applied by any impact printing technique, such as offset printing, flexographic printing, gravure, and screen printing, but is preferably applied by non-impact printing, e.g., jetting or spraying onto the ink-receiving layer. Preferably the curable fluid is jetted on the ink-receiving layer by inkjet printing.

The curable fluid is jetted on the ink-receiving layer according to a first image, the so-called "security image". The ink-receiving layer and the curable fluid are then at least partially cured by an exposure to actinic radiation, thermal curing, or by electron beam curing. After curing, at least one ink-jet ink is jetted on the ink-receiving layer according to a second image, the so-called "main image". An authentication mark is created when the main image partially overlaps with the security image.

In a preferred embodiment, after curing, at least two ink-jet inks are jetted on the ink-receiving layer and more preferably three color inks are jetted to form the "main image". The three color inks are part of an inkjet ink set including cyan, magenta, and yellow inks. The inkjet ink set is preferably an aqueous dye or pigment based inkjet ink set.

In a preferred embodiment, the at least partially curing is performed by overall curing, i.e., the complete security image is cured. In another preferred embodiment, the overall curing includes full curing instead of partial curing of all curable compounds.

The curable fluid for use in the ink-jet printing method according to a preferred embodiment of the present invention contains a curable compound. Any monomer or oligomer may be used as the curable compound. A combination of monomers, oligomers and/or prepolymers is preferably used in the curable fluid. The monomers, oligomers and/or prepolymers may possess different degrees of functionality, and a mixture including combinations of mono-, di-, tri- and higher functionality monomers, oligomers and/or prepolymers may be used.

The curable fluid for use in the ink-jet printing method according to a preferred embodiment of the present invention preferably further contains an initiator. If the curable fluid consists of a curable compound or a mixture of curable compounds, then preferably an initiator is present in the ink-receiving layer.

The curable fluid may contain a polymerization inhibitor to restrain polymerization by heat or actinic radiation actinic radiation during storage.

The curable fluid preferably further contains at least one surfactant.

The curable fluid may further contain at least one solvent.

The curable fluid may further contain at least one biocide.

The curable fluid may be a curable ink-jet ink containing a colorant or a white pigment such as titanium oxide, although preferably the curable fluid is a clear fluid. Instead of only one curable ink-jet ink, curable ink-jet ink sets including three or more curable ink-jet inks may be used to obtain a security image consisting of different colors. Preferred curable ink-jet ink sets include cyan, magenta, and yellow curable ink-jet ink. A black curable ink-jet ink or other color curable ink-jet inks (red, green, blue, etc.) may be added. The curable ink-jet ink set can also be a multi-density ink-jet ink set including at least one combination of curable ink-jet inks with about the same hue but different chroma and lightness.

The curable ink-jet ink may further contain at least one polymeric dispersant in order to obtain a stable dispersion of a pigment in the ink-jet ink.

Curable Compounds

Any monomer or oligomer may be used as the curable compound in the curable fluid used in the ink-jet printing method according to a preferred embodiment of the present invention. However, if the ink-receiving layer is hydrophilic, preferably a water-soluble or a water-dispersable monomer is used.

A combination of monomers, oligomers and/or prepolymers may also be used. The monomers, oligomers and/or prepolymers may possess different degrees of functionality, and a mixture including combinations of mono-, di-, tri- and higher functionality monomers, oligomers and/or prepolymers may be used.

The curable compound(s) used in the ink-jet printing method according to a preferred embodiment of the present invention can be any monomer and/or oligomer found in Polymer Handbook, Vol. 1+2, 4th edition, edited by J. BRANDRUP et al., Wiley-Interscience, 1999.

Suitable examples of monomers include acrylic acid, methacrylic acid, maleic acid (or their salts), maleic anhydride; alkyl(meth)acrylates (linear, branched and cycloalkyl) such as methyl(meth)acrylate, n-butyl(meth)acrylate, tert-butyl(meth)acrylate, cyclohexyl(meth)acrylate, and 2-ethylhexyl(meth)acrylate; aryl(meth)acrylates such as benzyl (meth)acrylate and phenyl(meth)acrylate; hydroxyalkyl (meth)acrylates such as hydroxyethyl(meth)acrylate and hydroxypropyl(meth)acrylate; (meth)acrylates with other types of functionalities (e.g., oxirane, amino, fluoro, polyethylene oxide, phosphate-substituted) such as glycidyl (meth) acrylate, dimethylaminoethyl(meth)acrylate, trifluoroethyl acrylate, methoxypolyethyleneglycol (meth)acrylate, and tripropyleneglycol(meth)acrylate phosphate; allyl derivatives such as allyl glycidyl ether; styrenics such as styrene, 4-methylstyrene, 4-hydroxystyrene, and 4-acetoxystyrene; (meth)acrylonitrile; (meth)acrylamides (including N-mono and N,N-disubstituted) such as N-benzyl(meth)acrylamide; maleimides such as N-phenyl maleimide, N-benzyl maleimide and N-ethyl maleimide; vinyl derivatives such as vinylcaprolactam, vinylpyrrolidone, vinylimidazole, vinylnaphthalene, and vinyl halides; vinylethers such as vinylmethyl ether; and vinylesters of carboxylic acids such as vinylacetate and vinylbutyrate.

Initiators

The curable fluid used in the ink-jet printing method according to a preferred embodiment of the present invention preferably also contains an initiator. The initiator typically initiates the polymerization reaction. The initiator can be a thermal initiator, but is preferably a photo-initiator. The photo-initiator requires less energy to activate than the monomers, oligomers and/or prepolymers to form the polymer. The photo-initiator suitable for use in the curable fluid may be a Norrish type I initiator, a Norrish type II initiator, or a photo-acid generator.

The thermal initiator(s) suitable for use in the curable fluid include tert-Amyl peroxybenzoate, 4,4-Azobis(4-cyanovaleric acid), 1,1'-Azobis(cyclohexanecarbonitrile), 2,2'-Azobisisobutyronitrile (AIBN), Benzoyl peroxide, 2,2-Bis(tert-butylperoxy)butane, 1,1-Bis(tert-butylperoxy)cyclohexane, 1,1-Bis(tert-butylperoxy)cyclohexane, 2,5-Bis(tert-butylperoxy)-2,5-dimethylhexane, 2,5-Bis(tert-Butylperoxy)-2,5-dimethyl-3-hexyne, Bis(1-(tert-butylperoxy)-1-methylethyl) benzene, 1,1-Bis(tert-butylperoxy)-3,3,5-trimethylcyclohexane, tert-Butyl hydroperoxide, tert-Butyl peracetate, tert-Butyl peroxide, tert-Butyl peroxybenzoate, tert-Butylperoxy isopropyl carbonate, Cumene hydroperoxide, Cyclohexanone peroxide, Dicumyl peroxide, Lauroyl peroxide, 2,4-Pentanedione peroxide, Peracetic acid, and Potassium persulfate.

The photo-initiator absorbs light and is responsible for the production of free radicals or cations. Free radicals or cations are high-energy species that induce polymerization of monomers, oligomers, and polymers and with polyfunctional monomers and oligomers thereby also inducing cross-linking.

Irradiation with actinic radiation may be realized in two steps by changing wavelength or intensity. In such cases it is preferred to use two types of photo-initiators together.

A combination of different types of initiators, for example, a photo-initiator and a thermal initiator can also be used.

A preferred Norrish type I-initiator is selected from the group consisting of benzoinethers, benzil ketals, α,α-dialkoxyacetophenones, α-hydroxyalkylphenones, α-aminoalkylphenones, acylphosphine oxides, acylphosphine sulphides, α-haloketones, α-halosulfones, and α-halophenylglyoxalates.

A preferred Norrish type II-initiator is selected from the group consisting of benzophenones, thioxanthones, 1,2-diketones, and anthraquinones. A preferred co-initiator is selected from the group consisting of an aliphatic amine, an aromatic amine and a thiol. Tertiary amines, heterocyclic thiols and 4-dialkylamino-benzoic acid are particularly preferred as co-initiator.

Suitable photo-initiators are disclosed in J. V. CRIVELLO et al., VOLUME III: Photoinitiators for Free Radical Cationic & Anionic Photopolymerization, 2nd edition, edited by G. BRADLEY, London, UK: John Wiley and Sons Ltd., 1998, pp. 287-294.

Specific examples of photo-initiators may include, but are not limited to, the following compounds or combinations thereof: benzophenone and substituted benzophenones, 1-hydroxycyclohexyl phenyl ketone, thioxanthones such as isopropylthioxanthone, 2-hydroxy-2-methyl-1-phenylpropan-1-one, 2-benzyl-2-dimethylamino-(4-morpholinophenyl) butan-1-one, benzil dimethylketal, bis(2,6-dimethylbenzoyl)-2,4,4-trimethylpentylphosphine oxide, 2,4,6-trimethylbenzoyldiphenylphosphine oxide, 2-methyl-1-[4-(methylthio)phenyl]-2-morpholinopropan-1-one, 2,2-dimethoxy-1,2-diphenylethan-1-one or 5,7-diiodo-3-butoxy-6-fluorone, diphenyliodonium fluoride and triphenylsulfonium hexafluophosphate.

Suitable commercial photo-initiators include Irgacure™ 184, Irgacure™ 500, Irgacure™ 907, Irgacure™ 369, Irgacure™ 1700, Irgacure™ 651, Irgacure™ 819, Irgacure™ 1000, Irgacure™ 1300, Irgacure™ 1870, Darocur™ 1173, Darocur™ 2959, Darocur™ 4265 and Darocur™ ITX available from CIBA SPECIALTY CHEMICALS, Lucerin TPO available from BASF AG, Esacure™ KT046, Esacure™ KIP150, Esacure™ KT37 and Esacure™ EDB available from LAMBERTI, H-Nu™ 470 and H-Nu™ 470X available from SPECTRA GROUP Ltd.

Suitable cationic photo-initiators include compounds, which form aprotic acids or Bronstead acids upon exposure to ultraviolet and/or visible light sufficient to initiate polymerization. The photo-initiator used may be a single compound, a mixture of two or more active compounds, or a combination of two or more different compounds, i.e., co-initiators. Non-limiting examples of suitable cationic photo-initiators are aryldiazonium salts, diaryliodonium salts, triarylsulphonium salts, triarylselenonium salts and the like.

The curable fluid may contain a photo-initiator system containing photo-initiator(s) and one or more sensitizer dyes that absorb light and transfer energy to the photo-initiator(s). Suitable sensitizer dyes include photoreducible xanthene, fluorene, benzoxanthene, benzothioxanthene, thiazine, oxazine, coumarin, pyronine, porphyrin, acridine, azo, diazo, cyanine, merocyanine, diarylmethyl, triarylmethyl, anthraquinone, phenylenediamine, benzimidazole, fluorochrome, quinoline, tetrazole, naphthol, benzidine, rhodamine, indigo and/or indanthrene dyes. Also suitable are optical brighteners. The amount of the sensitizer dyes is in general from 0.01 wt % to 15 wt %, for example, preferably from 0.05 wt % to 5 wt %, for example, based in each case on the total weight of the curable fluid.

In order to increase the photosensitivity further, the curable fluid may additionally contain co-initiators. For example, the combination of titanocenes and trichloromethyl-s-triazines, of titanocenes and ketoxime ethers and of acridines and trichloromethyl-s-triazines is known. A further increase in sensitivity can be achieved by adding dibenzalacetone or amino acid derivatives. The amount of co-initiator or co-initiators is in general from 0.01 wt % to 20 wt %, for example, preferably from 0.05 wt % to 10 wt %, for example, based in each case on the total weight of the curable fluid.

A preferred amount of initiator is 0.3 wt % to 50 wt %, for example, of the total weight of the curable fluid, and more preferably 1 wt % to 15 wt %, for example, of the total weight of the curable fluid.

Irradiation with actinic radiation may be realized in two steps by changing wavelength or intensity. In such cases it is preferred to use two types of photo-initiator together.

Inhibitors

Suitable polymerization inhibitors include phenol type antioxidants, hindered amine light stabilizers, phosphor type antioxidants, hydroquinone monomethyl ether commonly used in (meth)acrylate monomers, and hydroquinone, t-butylcatechol, pyrogallol may also be used. Of these, a phenol compound having a double bond in molecules derived from acrylic acid is particularly preferred due to its having a polymerization-restraining effect even when heated in a closed, oxygen-free environment. Suitable inhibitors are, for example, Sumilizer™ GA-80, Sumilizer™ GM and Sumilizer™ GS produced by Sumitomo Chemical Co., Ltd, Ciba Irgastab™ UV10 from CIBA Specialty Products and Genorad™ 16 available from RAHN.

Since excessive addition of these polymerization inhibitors will lower the sensitivity to curing, it is preferred that the amount capable of preventing polymerization be determined prior to blending. The amount of a polymerization inhibitor is generally between 200 ppm and 20,000 ppm, for example, of the total weight of the curable fluid.

Surfactants

The curable fluid used in the ink-jet printing method according to a preferred embodiment of the present invention may contain at least one surfactant. The surfactant(s) can be anionic, cationic, non-ionic, or zwitter-ionic and are usually added in a total quantity below 20 wt %, for example, based on the total curable fluid weight and particularly in a total below 10 wt %, for example, based on the total weight of the curable fluid.

A fluorinated or silicone compound may be used as a surfactant, however, a potential drawback is bleed-out after image formation because the surfactant does not cross-link. It is therefore preferred to use a copolymerizable monomer having surface-active effects, for example, silicone-modified acrylates, silicone modified methacrylates, fluorinated acrylates, and fluorinated methacrylates.

Dispersion Medium

The curable fluid preferably contains monomers and/or oligomers as the dispersion medium but may further include water and/or organic solvents, such as alcohols, fluorinated solvents and dipolar aprotic solvents.

However, the curable fluid preferably does not contain an evaporable component, but sometimes it can be advantageous to incorporate an extremely small amount of an organic solvent in such inks to improve penetration of the curable fluid into the ink-receiving layer or adhesion to the surface of the ink-receiving layer after UV curing. In this case, the added solvent can be any amount in the range which does not cause problems of solvent resistance and VOC, and preferably 0.1 wt % to 5.0 wt %, for example, and particularly preferably 0.1 wt % to 3.0 wt %, for example, each based on the total weight of the curable fluid.

Suitable organic solvents include alcohol, aromatic hydrocarbons, ketones, esters, aliphatic hydrocarbons, higher fatty acids, carbitols, cellosolves, higher fatty acid esters. Suitable alcohols include, methanol, ethanol, propanol and 1-butanol, 1-pentanol, 2-butanol, t.-butanol. Suitable aromatic hydrocarbons include toluene, and xylene. Suitable ketones include methyl ethyl ketone, methyl isobutyl ketone, 2,4-pentanedione and hexafluoroacetone. Also glycol, glycolethers, N-methylpyrrolidone, N,N-dimethylacetamid, N,N-dimethylformamid may be used.

Biocides

Suitable biocides for the curable fluid used in the ink-jet printing method according to a preferred embodiment of the present invention include sodium dehydroacetate, 2-phenoxyethanol, sodium benzoate, sodium pyridinethion-1-oxide, ethyl p-hydroxybenzoate and 1,2-benzisothiazolin-3-one and salts thereof. A preferred biocide for the curable fluid is Proxel™ GXL available from ZENECA COLOURS.

A biocide is preferably added in an amount of 0.001 wt % to 3 wt %, for example, more preferably 0.01 wt % to 1.00 wt %, for example, each based on the curable fluid.

Colorants

The curable fluid used in the ink-jet printing method according to a preferred embodiment of the present invention may be a curable ink-jet ink containing at least one colorant. Colorants used in the curable ink-jet ink may be dyes, pigments or a combination thereof. Organic and/or inorganic pigments may be used.

The pigment used in the curable ink-jet ink may be white, black, cyan, magenta, yellow, red, orange, violet, blue, green, brown, mixtures thereof, and the like.

The pigment may be chosen from those disclosed by W. HERBST et al., Industrial Organic Pigments, Production, Properties, Applications, 2nd edition, VCH, 1997.

Particular preferred pigments are C.I. Pigment Yellow 1, 3, 10, 12, 13, 14, 17, 55, 65, 73, 74, 75, 83, 93, 109, 120, 128, 138, 139, 150, 151, 154, 155, 180, and 185.

Particular preferred pigments are C.I. Pigment Red 17, 22, 23, 41, 48:1, 48:2, 49:1, 49:2, 52:1, 57:1, 81:1, 81:3, 88, 112, 122, 144, 146, 149, 169, 170, 175, 176, 184, 185, 188, 202, 206, 207, 210, 221, 248, 251, and 264.

Particular preferred pigments are C.I. Pigment Violet 1, 2, 19, 23, 32, 37, and 39.

Particular preferred pigments are C.I. Pigment Blue 15:1, 15:2, 15:3, 15:4, 16, 56, 61, and (bridged) aluminum phthalocyanine pigments.

Particular preferred pigments are C.I. Pigment Orange 5, 13, 16, 34, 67, 71, and 73.

Particular preferred pigments are C.I. Pigment Green 7 and 36.

Particular preferred pigments are C.I. Pigment Brown 6 and 7.

Particular preferred pigments are C.I. Pigment White 6.

Particular preferred pigments are C.I. Pigment Metal 1, 2 and 3.

For a curable black ink-jet ink, suitable pigment materials include carbon blacks such as Regal™ 400R, Mogul™ L, Elftex™ 320 from Cabot Co., or Carbon Black FW18, Special Black™ 250, Special Black™ 350, Special Black™ 550, Printex™ 25, Printex™ 35, Printex™ 55, Printex™ 150T from DEGUSSA Co., and C.I. Pigment Black 7 and C.I. Pigment Black 11.

The pigment particles in the curable ink-jet ink should be sufficiently small to permit free flow of the ink through the ink-jet printing device, especially at the ejecting nozzles. It is also desirable to use small particles for maximum color strength.

The average particle size of the pigment in the pigmented ink-jet ink should be between 0.005 μm and 15 μm, for example. Preferably, the average pigment particle size is between 0.005 μm and 5 μm, for example, more preferably between 0.005 and 1 μm, for example, particularly preferably between 0.005 μm and 0.3 μm, for example, and most preferably between 0.040 μm and 0.150 μm, for example. Larger pigment particle sizes may be used as long as the advantages of preferred embodiments of the present invention are achieved.

The dyes used in the curable ink-jet ink may be black, cyan, magenta, yellow, red, orange, violet, blue, green, brown, mixtures thereof, and may be selected from any dye listed below for the ink-jet ink.

In a preferred embodiment, the colorant is a fluorescent colorant used to introduce additional security features. Suitable examples of a fluorescent colorant include Tinopal™ grades such as Tinopal™ SFD, Uvitex™ grades such as Uvitex™ NFW and Uvitex™ OB, all available from CIBA SPECIALTY CHEMICALS; Leukophor™ grades from CLARIANT and Blancophor™ grades such as Blancophor™ REU and Blancophor™ BSU from BAYER.

The colorant is used in the curable ink-jet ink in an amount of 0.1 wt % to 20 wt %, for example, preferably 1 wt % to 10 wt %, for example, based on the total weight of the curable ink-jet ink.

Polymeric Dispersants

The curable ink-jet ink used as a curable fluid in a preferred embodiment of the present invention may further contain a polymeric dispersant, in order to obtain a stable dispersion of the pigment(s) in the ink-jet ink.

Polymeric dispersants are not specifically restricted, but the following resins are preferred: petroleum type resins (e.g., styrene type, acryl type, polyester, polyurethane type, phenol type, butyral type, cellulose type, and rosin); and thermoplastic resins (e.g., vinyl chloride, vinylacetate type). Specific examples of these resins include acrylate copolymers, styrene-acrylate copolymers, acetalized and incompletely saponified polyvinyl alcohol, and vinylacetate copolymers. Commercial resins are known under the tradenames Solsperse™ 32000 and Solsperse™ 39000 available from AVECIA, EFKA™ 4046 available from EFKA CHEMICALS BV, and Disperbyk™ 168 available from BYK CHEMIE GMBH.

Preferably, a polymeric dispersant is used, but sometimes non-polymeric dispersants are also suitable. A detailed list of non-polymeric as well as some polymeric dispersants is disclosed by M C CUTCHEON, Functional Materials, North American Edition, Glen Rock, N.J.: Manufacturing Confectioner Publishing Co., 1990, pp. 110-129.

Typically dispersants are incorporated at 2.5% to 200%, for example, more preferably at 50% to 150%, for example, by weight of the pigment.

Curing Device

The ink-receiving layer and the curable fluid can be cured by exposing it to actinic radiation, by thermal curing and/or by electron beam curing. A preferred process of radiation curing is by ultraviolet radiation. Preferably the curing is performed by an overall exposure to actinic radiation, by overall thermal curing, or by overall electron beam curing.

When the curable fluid containing the curable compound is jetted on the ink-receiving layer according to a security image, the curing device may be arranged in combination with the print head of the ink-jet printer, traveling therewith so that the security image printed on the ink-receiving layer is exposed to curing radiation very shortly after having been printed upon the ink-receiver. In such an arrangement, it can be difficult to provide a small enough radiation source connected to and traveling with the print head. Therefore, a static fixed radiation source may be used, e.g., a source of curing UV radiation, connected to the radiation source by a flexible radiation conductive device such as a fiber optic bundle or an internally reflective flexible tube.

Alternatively, the actinic radiation may be supplied from a fixed source to the radiation head by an arrangement of mirrors including a mirror upon the radiation head.

The source of radiation arranged not to move with the print head may also be an elongate radiation source extending transversely across the ink-receiver surface to be cured and adjacent the transverse path of the print head so that the subsequent rows of images formed by the print head are passed, stepwise or continually, beneath the radiation source.

Any ultraviolet light source, as long as part of the emitted light can be absorbed by the photo-initiator (system), may be used as a radiation source, such as, a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing.

UV radiation is generally classed as UV-A, UV-B, and UV-C as follows:

UV-A: 400 nm to 320 nm

UV-B: 320 nm to 290 nm

UV-C: 290 nm to 100 nm.

Furthermore, it is possible to cure the security image using two light sources of differing wavelengths or illuminance. For example, the first UV source can be selected to be rich in UV-C, in particular in the range of 240 nm to 200 nm. The second UV source can then be rich in UV-A, e.g., a gallium-doped lamp, or a different lamp high in both UV-A and UV-B. The use of two UV sources has been found to have advantages, e.g., a fast curing speed.

For facilitating curing, the ink-jet printer often includes one or more oxygen depletion units. The oxygen depletion units place a blanket of nitrogen or other relatively inert gas (e.g., $CO_2$), with adjustable position and adjustable inert gas concentration, in order to reduce the oxygen concentration in the curing environment. Residual oxygen levels are usually maintained as low as 200 ppm, for example, but are generally in the range of 200 ppm to 1200 ppm, for example.

Thermal curing can be performed image-wise by use of a thermal head, a heat stylus, hot stamping, a laser beam, etc. If a laser beam is used, then preferably an infrared laser is used in combination with an infrared dye in the ink-receiving layer.

Ink-Jet Ink

The at least one ink-jet ink used in the ink-jet printing method according to a preferred embodiment of the present invention contains at least one colorant. Instead of only one ink-jet ink, preferably ink-jet ink sets including three or more ink-jet inks are used to obtain full color images. Preferred ink-jet ink sets include cyan, magenta, and yellow ink-jet inks. A black ink-jet ink or other color ink-jet inks (red, green, blue, etc.) may be added. The ink-jet ink set can also be a multi-density ink-jet ink set including at least one combination of ink-jet inks with about the same hue but different chroma and lightness.

The at least one ink-jet ink may contain curable compounds as described above for the curable fluid but is preferably free of curable compounds.

The ink-jet ink used in the ink-jet printing method according to a preferred embodiment of the present invention may further include at least one polymeric dispersant.

The ink-jet ink used in the ink-jet printing method according to a preferred embodiment of the present invention may further include at least one thickener for viscosity regulation in the ink-jet ink.

The ink-jet ink used in the ink-jet printing method according to a preferred embodiment of the present invention may further include at least one surfactant.

A biocide may be added to the ink-jet ink used in the ink-jet printing method according to a preferred embodiment of the present invention to prevent unwanted microbial growth, which may occur in the ink-jet ink over time. The biocide may be used either singly or in combination.

The ink-jet ink used in the ink-jet printing method according to a preferred embodiment of the present invention may contain at least one humectant to prevent the clogging of the nozzle due to its ability to slow the evaporation rate of ink.

The ink-jet ink used in the ink-jet printing method according to a preferred embodiment of the present invention may further include at least one antioxidant for improving the storage stability of an image.

The ink-jet ink used in the ink-jet printing method according to a preferred embodiment of the present invention may include additives such as buffering agents, anti-mold agents, pH adjustment agents, electric conductivity adjustment agents, chelating agents, anti-rusting agents, light stabilizers, dendrimers, polymers, and the like. Such additives may be included in the ink-jet ink used in the ink-jet printing method according to a preferred embodiment of the present invention in any effective amount, as desired.

The ink-jet ink used in the ink-jet printing method according to a preferred embodiment of the present invention may further include conducting or semi-conducting polymers, such as polyanilines, polypyrroles, polythiophenes such as poly(ethylenedioxythiophene) (PEDOT), substituted or unsubstituted poly(phenylenevinylenes) (PPVs) such as PPV and MEH-PPV, polyfluorenes such as PF6, etc.

Colorants

The ink-jet ink used in the ink-jet printing method according to a preferred embodiment of the present invention contains at least one colorant. Colorants used in the ink-jet ink may be pigments, dyes or a combination thereof. Organic and/or inorganic pigments may be used.

The pigment used in the ink-jet ink may be black, cyan, magenta, yellow, red, orange, violet, blue, green, brown, mixtures thereof, and may be selected from any pigment listed above for the curable fluid.

The pigment particles in the ink-jet ink should be sufficiently small to permit free flow of the ink through the ink-jet printing device, especially at the ejecting nozzles. It is also desirable to use small particles for maximum color strength.

The average particle size of the pigment in the ink-jet ink should be between 0.005 μm and 15 μm, for example. Preferably, the average pigment particle size is between 0.005 μm and 5 μm, for example, more preferably between 0.005 μm and 1 μm, for example, particularly preferably between 0.005 μm and 0.3 μm, for example, and most preferably between 0.040 μm and 0.150 μm, for example. Larger pigment particle sizes may be used as long as the advantages of preferred embodiments of the present invention are achieved.

The pigment is used in the ink-jet ink in an amount of 0.1 wt % to 20 wt %, for example, preferably 1 wt % to 10 wt %, for example, based on the total weight of the ink-jet ink.

Dyes suitable for the ink-jet ink used in the ink-jet printing method according to a preferred embodiment of the present invention include direct dyes, acidic dyes, basic dyes, and reactive dyes.

Suitable direct dyes for the ink-jet ink used in the ink-jet printing method according to a preferred embodiment of the present invention include:

C.I. Direct Yellow 1, 4, 8, 11, 12, 24, 26, 27, 28, 33, 39, 44, 50, 58, 85, 86, 100, 110, 120, 132, 142, and 144

C.I. Direct Red 1, 2, 4, 9, 11, 134, 17, 20, 23, 24, 28, 31, 33, 37, 39, 44, 47, 48, 51, 62, 63, 75, 79, 80, 81, 83, 89, 90, 94, 95, 99, 220, 224, 227, and 343

C.I. Direct Blue 1, 2, 6, 8, 15, 22, 25, 71, 76, 78, 80, 86, 87, 90, 98, 106, 108, 120, 123, 163, 165, 192, 193, 194, 195, 196, 199, 200, 201, 202, 203, 207, 236, and 237

C.I. Direct Black 2, 3, 7, 17, 19, 22, 32, 38, 51, 56, 62, 71, 74, 75, 77, 105, 108, 112, 117, 154, and 195

Suitable acidic dyes for the ink-jet ink used in the ink-jet printing method according to a preferred embodiment of the present invention include:

C.I. Acid Yellow 2, 3, 7, 17, 19, 23, 25, 20, 38, 42, 49, 59, 61, 72, and 99

C.I. Acid Orange 56 and 64

C.I. Acid Red 1, 8, 14, 18, 26, 32, 37, 42, 52, 57, 72, 74, 80, 87, 115, 119, 131, 133, 134, 143, 154, 186, 249, 254, and 256

C.I. Acid Violet 11, 34, and 75

C.I. Acid Blue 1, 7, 9, 29, 87, 126, 138, 171, 175, 183, 234, 236, and 249

C.I. Acid Green 9, 12, 19, 27, and 41

C.I. Acid Black 1, 2, 7, 24, 26, 48, 52, 58, 60, 94, 107, 109, 110, 119, 131, and 155

Suitable reactive dyes for the ink-jet ink used in the ink-jet printing method according to a preferred embodiment of the present invention include:

C.I. Reactive Yellow 1, 2, 3, 14, 15, 17, 37, 42, 76, 95, 168, and 175

C.I. Reactive Red 2, 6, 11, 21, 22, 23, 24, 33, 45, 111, 112, 114, 180, 218, 226, 228, and 235

C.I. Reactive Blue 7, 14, 15, 18, 19, 21, 25, 38, 49, 72, 77, 176, 203, 220, 230, and 235

C.I. Reactive Orange 5, 12, 13, 35, and 95

C.I. Reactive Brown 7, 11, 33, 37, and 46

C.I. Reactive Green 8 and 19

C.I. Reactive Violet 2, 4, 6, 8, 21, 22, and 25

C.I. Reactive Black 5, 8, 31, and 39

Suitable basic dyes for the ink-jet ink used in the ink-jet printing method according to a preferred embodiment of the present invention include:

C.I. Basic Yellow 11, 14, 21, and 32

C.I. Basic Red 1, 2, 9, 12, and 13

C.I. Basic Violet 3, 7, and 14

C.I. Basic Blue 3, 9, 24, and 25

Dyes can only manifest the ideal color in an appropriate range of pH value. Therefore, the ink-jet ink used in the ink-jet printing method according to a preferred embodiment of the present invention preferably further includes a pH adjuster.

In a preferred embodiment, the colorant is a fluorescent colorant used to introduce additional security features. Suitable examples of a fluorescent colorant include Tinopal™ grades such as Tinopal™ SFD, Uvitex™ grades such as Uvitex™ NFW and Uvitex™ OB, all available from CIBA SPECIALTY CHEMICALS; Leukophor™ grades from CLARIANT and Blancophor™ grades such as Blancophor™ REU and Blancophor™ BSU from BAYER.

The dye is used in the ink-jet ink in an amount of 0.1 wt % to 30 wt %, for example, preferably 1 wt % to 20 wt %, for example, based on the total weight of the ink-jet ink.

Polymeric Dispersants

In the preparation of the ink-jet ink used in the ink-jet printing method according to a preferred embodiment of the present invention, the pigment may be added in the form of a dispersion including a polymeric dispersant, which is also called a pigment stabilizer.

The polymeric dispersant may be, for example, of the polyester, polyurethane, polyvinyl of polyacrylate type, especially in the form of copolymer or block copolymer with a molecular weight between 2000 and 100000, for example, and would typically be incorporated at 2.5% to 200%, for example, by weight of the pigment.

Suitable examples are DISPERBYK™ dispersants available from BYK CHEMIE, JONCRYL™ dispersants available from JOHNSON POLYMERS and SOLSPERSE™ dispersants available from ZENECA. A detailed list of non-polymeric as well as some polymeric dispersants is disclosed by M C CUTCHEON, Functional Materials, North American Edition, Glen Rock, N.J.: Manufacturing Confectioner Publishing Co., 1990, pp. 110-129.

Dispersion Medium

The dispersion medium used in the ink-jet ink used in the ink-jet printing method according to a preferred embodiment of the present invention is a liquid, and may contain water and/or organic solvents, such as alcohols, fluorinated solvents and dipolar aprotic solvents. The dispersion medium is preferably present in a concentration between 10 wt % and 80 wt %, for example, particularly preferably between 20 wt % and 50 wt %, for example, each based on the total weight of the ink-jet ink. Preferably the dispersion medium is water.

Suitable organic solvents include alcohols, aromatic hydrocarbons, ketones, esters, aliphatic hydrocarbons, higher fatty acids, carbitols, cellosolves, higher fatty acid esters. Suitable alcohols include, methanol, ethanol, propanol and 1-butanol, 1-pentanol, 2-butanol, t.-butanol. Suitable aromatic hydrocarbons include toluene, and xylene. Suitable ketones include methyl ethyl ketone, methyl isobutyl ketone, 2,4-pentanedione, and hexafluoroacetone. Also glycol, glycolethers, N-methylpyrrolidone, N,N-dimethylacetamid, N,N-dimethylformamid may be used.

Thickeners

Suitable thickeners for use in the ink-jet ink used in the ink-jet printing method according to a preferred embodiment of the present invention include urea or urea derivatives, hydroxyethylcellulose, carboxymethylcellulose, hydroxypropylcellulose, derived chitin, derived starch, carrageenan, and pullulan; DNA, proteins, poly(styrenesulphonic acid), poly(styrene-co-maleic anhydride), poly(alkyl vinyl ether-co-maleic anhydride), polyacrylamid, partially hydrolyzed polyacrylamid, poly(acrylic acid), poly(vinyl alcohol), partially hydrolyzed poly(vinyl acetate), poly(hydroxyethyl acrylate), poly(methyl vinyl ether), polyvinylpyrrolidone, poly(2-vinylpyridine), poly(4-vinylpyridine), and poly(diallyldimethylammonium chloride).

The thickener is added preferably in an amount of 0.01 wt % to 20 wt %, for example, more preferably 0.1 wt % to 10 wt %, for example, based on the ink-jet ink.

Preferably, the viscosity of the ink-jet ink used in the ink-jet printing method according to a preferred embodiment of the present invention is lower than 50 mPa·s, for example, more preferably lower than 30 mPa·s, for example, and most preferably lower than 10 mPa·s, for example, at a shear rate of 100 s-1 and a temperature between 20 and 110° C.

Surfactants

The ink-jet ink used in the ink-jet printing method according to a preferred embodiment of the present invention may contain at least one surfactant. The surfactant(s) can be anionic, cationic, non-ionic, or zwitter-ionic and are usually added in a total quantity less than 20 wt %, for example, based on the total weight of the ink-jet ink and particularly in a total less than 10 wt %, for example, based on the total weight of the ink-jet ink.

Suitable surfactants for the ink-jet ink used in the ink-jet printing method according to a preferred embodiment of the present invention include fatty acid salts, ester salts of a higher alcohol, alkylbenzene sulphonate salts, sulphosuccinate ester salts and phosphate ester salts of a higher alcohol (for example, sodium dodecylbenzenesulphonate and sodium dioctylsulphosuccinate), ethylene oxide adducts of a higher alcohol, ethylene oxide adducts of an alkylphenol, ethylene oxide adducts of a polyhydric alcohol fatty acid ester, and acetylene glycol and ethylene oxide adducts thereof (for example, polyoxyethylene nonylphenyl ether, and SURFYNOL™ 104, 104H, 440, 465 and TG available from AIR PRODUCTS & CHEMICALS INC.).

Biocides

Suitable biocides for the ink-jet ink used in the ink-jet printing method according to a preferred embodiment of the present invention include sodium dehydroacetate, 2-phenoxyethanol, sodium benzoate, sodium pyridinethion-1-oxide, ethyl p-hydroxybenzoate and 1,2-benzisothiazolin-3-one and salts thereof.

Preferred biocides are Bronidox™ available from HENKEL and Proxel™ GXL available from ZENECA COLOURS.

A biocide is preferably added in an amount of 0.001 wt % to 3 wt %, for example, more preferably 0.01 wt % to 1.00 wt %, for example, each based on the total weight of the ink-jet ink.

pH Adjusters

The ink-jet ink used in the ink-jet printing method according to a preferred embodiment of the present invention may contain at least one pH adjuster. Suitable pH adjusters include NaOH, KOH, $NEt_3$, $NH_3$, HCl, $HNO_3$, $H_2SO_4$ and (poly) alkanolamines such as triethanolamine and 2-amino-2-methyl-1-propaniol. Preferred pH adjusters are NaOH and $H_2SO_4$.

Humectants

Suitable humectants include triacetin, N-methyl-2-pyrrolidone, glycerol, urea, thiourea, ethylene urea, alkyl urea, alkyl thiourea, dialkyl urea and dialkyl thiourea, diols, including ethanediols, propanediols, propanetriols, butanediols, pentanediols, and hexanediols; glycols, including propylene glycol, polypropylene glycol, ethylene glycol, polyethylene glycol, diethylene glycol, tetraethylene glycol, and mixtures and derivatives thereof. Preferred humectants are glycerol and 1,2-hexanediol. The humectant is preferably added to the inkjet ink formulation in an amount of 0.1 wt % to 20 wt %, for example, of the formulation, more preferably 0.1 wt % to 10 wt %, for example, of the formulation, and most preferably approximately 4.0 wt % to 6.0 wt %, for example.

Other Additives

In addition to the constituents, described above, the ink-jet ink may, if necessary, further contain following additives to have desired performance: evaporation accelerators, rust inhibitors, cross-linking agents, soluble electrolytes as conductivity aid, sequestering agents and chelating agents, and magnetic particles to introduce additional security features.

Preparation of Ink-Jet Ink

The ink-jet ink used in the ink-jet printing method according to a preferred embodiment of the present invention can be prepared by simply mixing all components when the colorant is a dye. When pigments are used, a pigment dispersion may be prepared by mixing, milling, and dispersion of pigment and polymeric dispersant. Mixing apparatuses may include a pressure kneader, an open kneader, a planetary mixer, a dissolver, and a Dalton Universal Mixer. Suitable milling and dispersion apparatuses are a ball mill, a pearl mill, a colloid mill, a high-speed disperser, double rollers, a bead mill, a paint conditioner, and triple rollers. The dispersions may also be prepared using ultrasonic energy.

Many different types of materials may be used as milling media, such as glasses, ceramics, metals, and plastics. In a preferred embodiment, the grinding media can include particles, preferably substantially spherical in shape, e.g., beads consisting essentially of a polymeric resin or yttrium stabilized zirconium beads.

In the process of mixing, milling, and dispersion, each process is preferably performed with cooling to prevent build up of heat.

If the ink-jet ink used in the ink-jet printing method according to a preferred embodiment of the present invention contains more than one pigment, the ink-jet ink may be prepared using separate dispersions for each pigment, or alternatively several pigments may be mixed and co-milled in preparing the dispersion.

The dispersion process can be carried out in a continuous, batch or semi-batch mode.

The preferred amounts and ratios of the ingredients of the mill grind will vary widely depending upon the specific materials and the intended applications. The contents of the milling mixture include the mill grind and the milling media. The mill grind includes pigment, polymeric dispersant and a liquid carrier such as water. For ink-jet inks, the pigment is usually present in the mill grind at 1 wt % to 50 wt %, for example, excluding the milling media. The weight ratio of pigment over polymeric dispersant is 20:1 to 1:2, for example.

The milling time can vary widely and depends upon the pigment, mechanical device, and residence conditions selected, the initial and desired final particle size, etc. In a preferred embodiment of the present invention, pigment dispersions with an average particle size of less than 100 nm, for example, may be prepared.

After milling is completed, the milling media is separated from the milled particulate product (in either a dry or liquid dispersion form) using conventional separation techniques, such as by filtration, sieving through a mesh screen, and the like. Often the sieve is built into the mill, e.g., for a bead mill. The milled pigment concentrate is preferably separated from the milling media by filtration.

In general, it is desirable to make the ink-jet inks in the form of a concentrated mill grind, which is subsequently diluted to the appropriate concentration for use in the ink-jet printing system. This technique permits preparation of a greater quantity of pigmented ink from the equipment. If the mill grind was made in a solvent, it is diluted with water and optionally other solvents to the appropriate concentration. If it was made in water, it is diluted with either additional water or water miscible solvents to make a mill grind of the desired concentration. By dilution, the ink-jet ink is adjusted to the desired viscosity, surface tension, color, hue, saturation density, and print area coverage for the particular application.

Overcoat Layer

In a preferred embodiment, the cured and ink-jet printed ink-receiver is coated with a radiation curable coating composition. The curing of this overcoat layer may result in changes of the contrast depending on the fact if a pigmented or a dye based ink-jet ink was used to print the main image partially overlapping with the security image.

Another observation is that the overcoat layer results in the formation of a relief with differences of height between 5 μm to 10 μm, for example. This kind of tactile printing can be used for introducing security features.

INDUSTRIAL APPLICABILITY

The authentication mark obtained by the ink-jet printing method according to a preferred embodiment of the present invention may be used in security documents, official documents issued by governments or other official and commercial institutions, bank notes, bonds, currency notes, checks, share certificates, stamps, tax receipts, official records, diplomas, identification documents, security tags, labels, tickets, security badges, credit cards, packaging, brands, trademarks, logos or documents suitable for attachment to and/or association with a product of substantial value such as antique objects, audio and/or visual media (e.g., compact disks, audio tapes and video tapes), chemical products, tobacco products, clothing articles, wines and alcoholic beverages, entertainment goods, foodstuffs, electrical and electronic goods, computer software, high technology machines and equipment, jewelry, leisure items, perfumes and cosmetics, products related to the treatment, diagnosis, therapy and prophylaxis of humans and animals, military equipment, photographic industry goods, scientific instruments and spare parts therefor, machinery and spare parts for the transport industry and travel goods.

EXAMPLES

Additional preferred embodiments of the present invention will now be described in detail by way of Examples hereinafter. The percentages and ratios given in these examples are by weight unless otherwise indicated. All preparations, curing and printing took place in a room where the light conditions were adapted to minimize UV-light.

Materials

All materials used in the following examples were readily available from Aldrich Chemical Co. (Belgium) unless otherwise specified. The "water" used in the examples was demineralized water.

The following materials were used:

SYLOID™ W300 from GRACE GMBH.

Poly(ViOH-ViAc) is POVAL™ R3109 from MITSUBISHI CHEMICAL EUROPE GMBH.

Cat Floc™ 71259 is a cationic polyelectrolyte from ONDEO NALCO EUROPE B.V.

Broxan™ is a 5 wt % aqueous solution of the biocide 5-Bromo-5-Nitro-1,3-Dioxane from HENKEL.

Sartomer™ SR9035 is water soluble ethoxylated (15) trimethylolpropane triacrylate from SARTOMER.

Co(Et-ViAc) is a ethylene-vinylacetate latex available under the tradename Polysol™ EVA P550 from SHOWA HIGH-POLYMERS COMPANY, Ltd.

Darocur™ 2959 is the photo-initiator 4-(2-hydroxyethoxy) phenyl (2-hydroxy-2-propyl)ketone from CIBA SPECIALTY CHEMICALS.

PET100 is a 100 μm subbed PET substrate with on the coating side a subbing layer and on the backside a subbing layer and an antistatic layer available from AGFA-GEVAERT as P100C S/S AS.

Example 1

This example illustrates the method of ink-jet printing used to manufacture authentication marks.

Preparation of the Ink Receiver

First a dispersion of silica, named DISP-1, was prepared by mixing the components according to Table 1.

TABLE 1

| Components | wt % based on total dispersion weight |
|---|---|
| SYLOID ™ W300 | 23.47 |
| Poly(ViOH-ViAc) | 3.53 |
| Cat Floc ™ 71259 | 2.14 |
| Broxan ™ | 0.04 |
| Citric acid | 0.42 |
| water | 70.40 |

The dispersion DISP-1 was then used to prepare the coating solution COAT-1 by mixing 712 g of DISP-1, 69 g of a 50 wt % solution of the polymer latex Co(Et-ViAc)) and 199 g of water.

The coating solution COAT-1 was coated on PET100 by a coating knife (wet thickness 67 μm). The coated ink-receivers REC-1 was then dried for 4 minutes in an oven at 60° C.

Curing of the Ink Receiver

A curable fluid is prepared by mixing the water-soluble monomer and the photo-initiator in water according to Table 2.

TABLE 2

| Components | Curable fluid (wt %) |
|---|---|
| Sartomer ™ SR9035 | 13.6 |
| Darocur ™ 2959 | 0.8 |
| Water | 85.6 |

Droplets of the prepared curable fluid were deposited on the ink-receiver REC-1 using a pipette. The ink receiver REC-1 was exposed with a CDL1502i from AGFA-GEVAERT at Level 3 (=4000 μW/cm$^2$) for 650 seconds.

Ink-Jet Printing

An EPSON PHOTO STYLUS™ R300 from SEIKO EPSON was used with an EPSON R300 ink-jet ink set and a printer setting "PHOTO (+HIGH SPEED)" to print an image containing a picture of a person and some text on the cured ink-receiver REC-1 in a way that the image was partially printed on areas where the curable fluid was deposited and partially on areas lacking the curable fluid.

Another sample of the cured ink receiver REC-1 was printed in the same manner with an EPSON STYLUS™ PHOTO R800 ink-jet printer using an EPSON R800 ink set, which consist of aqueous pigment based inks.

Result and Evaluation

Authentication marks became visible on the printed samples of the ink receiver REC-1.

The optical density of two color areas in the ink-jetted main image (Black and Magenta) with the EPSON PHOTO STYLUS™ R300 were measured in transmission using a MacBeth™ TD904 with a green filter and in reflection using a MacBeth™ RD918SB with a red filter, both in an area where the curable fluid was deposited and in an area lacking curable fluid. The measured results are given by Table 3.

TABLE 3

| | | Optical Density | |
|---|---|---|---|
| Color area | Curable fluid | Transmission | Reflection |
| Black | No | 3.80 | 1.60 |
| | Yes | 4.19 | 1.17 |
| Magenta | No | 1.14 | 0.87 |
| | Yes | 1.26 | 0.64 |

The optical density of two color areas in the ink-jetted main image (Green and Violet) with the EPSON STYLUS™ PHOTO R800 were measured in transmission using a MacBeth™ TD904 and in reflection using a MacBeth™ RD918SB, both in an area where the curable fluid was deposited and in an area lacking curable fluid. In both measurements, provided filters in the McBeth™ densitimeters were used: the blue filter for the green color area and the green filter for the violet color area. The measured results are given by Table 4.

TABLE 4

| | | Optical Density | |
|---|---|---|---|
| Color area | Curable fluid | Transmission | Reflection |
| Green | No | 0.86 | 0.96 |
| | Yes | 1.05 | 0.85 |
| Violet | No | 1.17 | 0.71 |
| | Yes | 1.32 | 0.63 |

From Table 3 and Table 4 it is clear that in transmission the optical density was enhanced in the areas of the ink receiver where cured curable fluid was present. In reflection a lower and opposite contrast was observed.

In an additional experiment it was found that no authentication marks were observed when the sample was not cured before printing the second image.

Example 2

This example illustrates that no authentication marks are obtained when the steps in the method of ink-jet printing are performed in a different order.

Ink-Jet Printing

The same ink receiver REC-1 of EXAMPLE 1 was printed upon with the non-radiation curable inkjet ink sets Epson Photo Stylus R800 and Epson Photo Stylus R300 before (=Order A) and after (=Order B) the radiation curable fluid of Table 2 was applied to the ink receiver. The inkjet printing, the curable fluid application and the radiation curing was performed in the same manner as in EXAMPLE 1.

The optical densities of two color areas in the ink-jetted main image were measured in reflection using a MacBeth™ RD918SB using a suitable color filter. The difference in optical density between a color area where the curable fluid was deposited and cured and the same color area lacking curable fluid is given by Table 5.

TABLE 5

| Inkjet | Color | RD918SB | Difference in optical density | |
|---|---|---|---|---|
| Ink set | area measured | Filter | Order A | Order B |
| Epson Photo | Green | Blue filter | ≦0.01 | 0.05 |
| Stylus R800 | Purple | Green filter | ≦0.01 | 0.08 |
| Epson Photo | Magenta | Green filter | ≦0.01 | 0.06 |
| Stylus R300 | Blue | Red filter | ≦0.01 | 0.06 |

From Table 5, it is clear that when the aqueous dye or pigment based inkjet inks were jetted before application of a curable fluid pattern, that no authentication marks were observed. However, when order B was used, i.e. first depositing and curing a curable fluid and then jetting the color inkjet inks, authentication marks were clearly observed.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method of ink-jet printing an authentication mark on an article comprising, in order, the steps of:

a) providing an article including an ink-receiving layer;

b) applying a curable ink-jet ink on the ink-receiving layer according to a first image;

c) at least partially curing the curable ink-jet ink; and d) jetting at least one aqueous ink-jet ink on the ink-receiving layer according to a second image partially overlapping with the first image; wherein the at least one aqueous ink-jet ink is free of curable compounds.

2. The method of ink-jet printing an authentication mark on an article according to claim 1, wherein the curable ink-jet ink is jetted onto the ink-receiving layer according to the first image.

3. The method of ink-jet printing an authentication mark on an article according to claim 1, wherein the ink-receiving layer and the curable ink-jet ink are overall cured in step c).

4. The method of ink-jet printing an authentication mark on an article according to claim 1, wherein the curing is performed by radiation curing or electron beam curing.

5. The method of ink-jet printing an authentication mark on an article according to claim 1, further comprising the step of:

e) providing an overcoat layer of a curable composition on the first and second images.

6. The method of ink-jet printing an authentication mark on an article according to claim 5, further comprising the step of:

f) overall curing the curable composition on the first and second images.

7. The method of ink-jet printing an authentication mark on an article according to claim 5, wherein step d) includes the step of printing at least three aqueous ink-jet inks on the ink-receiving layer to form the second image.

8. The method of ink-jet printing an authentication mark on an article according to claim 5, wherein the at least one aqueous ink-jet ink includes a dye.

9. The method of ink-jet printing an authentication mark on an article according to claim 5, wherein the at least one aqueous ink-jet ink includes a pigment.

* * * * *